United States Patent [19]

Maloy

[11] 4,394,017

[45] Jul. 19, 1983

[54] EARTHQUAKE GAME

[76] Inventor: Rick D. Maloy, Rte. 2, Newcomerstown, Ohio 43832

[21] Appl. No.: 270,894

[22] Filed: Jun. 5, 1981

[51] Int. Cl.[3] ..... A63F 3/00

[52] U.S. Cl. ..... 273/237; 273/256; 273/281; 273/282; 273/287

[58] Field of Search ..... 273/237, 287, 276; 46/1 C, 137, 140

[56] References Cited

U.S. PATENT DOCUMENTS

| | | | |
|---|---|---|---|
| 1,655,292 | 1/1928 | Przybylko et al. | 46/140 |
| 3,384,371 | 5/1968 | Ryan et al. | 273/281 X |
| 3,940,140 | 2/1976 | Meyer et al. | 273/109 |
| 4,147,358 | 4/1979 | Erikson | 273/241 |
| 4,303,240 | 12/1981 | Ellman et al. | 273/1 GF |
| 4,343,475 | 8/1982 | Stader | 273/276 |

FOREIGN PATENT DOCUMENTS

| | | | |
|---|---|---|---|
| 1131231 | 2/1957 | France | 46/1 C |

*Primary Examiner*—Richard C. Pinkham
*Assistant Examiner*—Scott L. Brown

[57] ABSTRACT

This game is unique, in that it will simulate the disasters and excitement of an earthquake, and it is competitive in play. It consists primarily of a board with positions to be played on, and a multiple number of simulated building structures may be placed on four squares that represent cities. It further includes player-operated mechanisms, which will tilt the squares, so as to simulate an earthquake, and the building structures may include pegs, for preventing them from toppling, when the squares are tilted.

7 Claims, 10 Drawing Figures

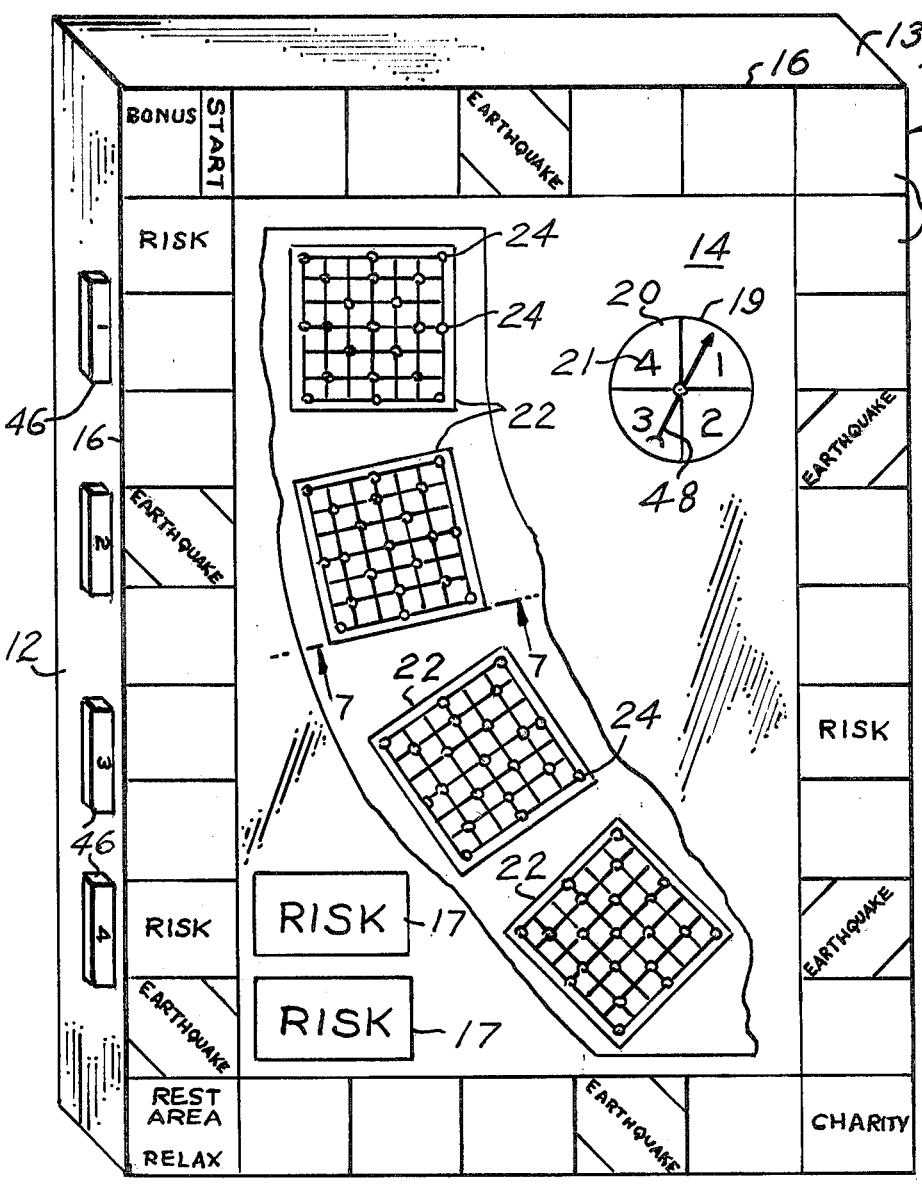
FIG. 1
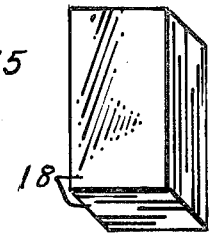
FIG. 2
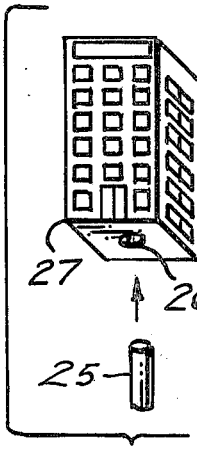
FIG. 3
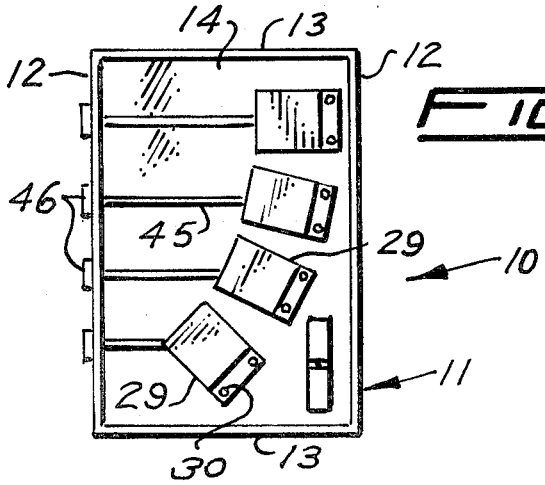
FIG. 4
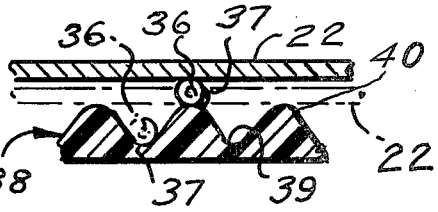
FIG. 5
FIG. 6
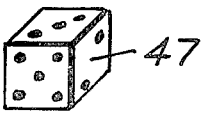

EARTHQUAKE GAME

This invention relates to game boards, and more particularly, to an earthquake game.

It is, therefore, the principal object of this invention to provide an earthquake game, which will be unique and novel.

Another object of this invention is to provide an earthquake game, which will simulate the disasters and excitement of an earthquake.

Another object of this invention is to provide an earthquake game, which will be played by two or four players, ranging in age from ten to adults.

Another object of this invention is to provide an earthquake game, which will include four squares, that represent cities, that are vibrated by switch controlled mechanisms underneath the game board.

A further object of this invention is to provide an earthquake game, which will have simulated building structures, for placement on the four squares that represent cities.

Other objects of the present invention are to provide an earthquake game, which is simple in design, inexpensive to manufacture, rugged in construction, easy to use and efficient in operation.

These, and other objects, will be readily evident, upon a study of the following specification, and the accompanying drawings, wherein:

FIG. 1 is a perspective view of a game board, comprising the present invention;

FIG. 2 is a perspective view of the cards, for use in playing the game;

FIG. 3 is an enlarged perspective view of one of the building structures, for use in playing the game;

FIG. 4 is a bottom plan view of FIG. 1, shown on a smaller scale, and illustrates the motor mounting plates, for vibrating the square members in the face of FIG. 1;

FIG. 5 is an enlarged fragmentary side elevational view of the roller lifting means, for vibrating one of the squares in the face of FIG. 1, the lowered position of the square and roller being shown in phantom;

FIG. 6 is a perspective view of one of the pair of dice used in playing the game;

Figure 7:
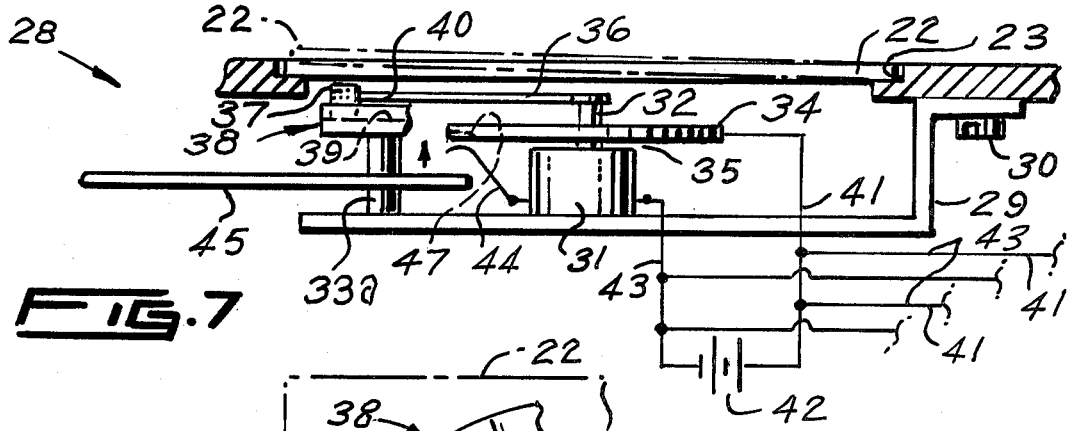
FIG. 7 is an enlarged cross-sectional view, taken along the line 7—7 of FIG. 1, and illustrates the tilting motion of the square in phantom.
Figure 8:
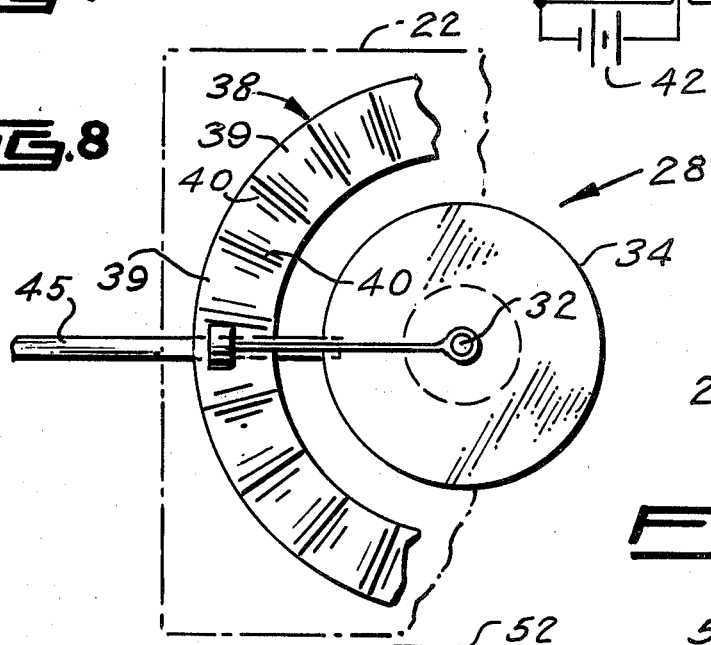
FIG. 8 is a fragmentary top plan view of FIG. 7, showing the movable square in phantom.
Figure 9:
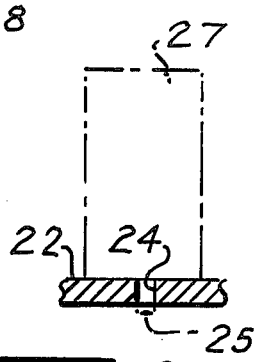
FIG. 9 is an enlarged cross-sectional view of one of the movable squares of FIG. 1, showing the mounting of one of the building structure playing pieces, which is illustrated in phantom.

According to this invention, game 10 is shown to include a board 11 of rectangular configuration, having a pair of side walls 12, a pair of end walls 13, and a top wall 14. On the face of top wall 14 are a plurality of adjacent segments 15, which form a border on the edges 16. Within the border, boxes 17 for the placing of cards 18, and a spinner 19 is divided into quarters 20, each quarter being of a different color, such as, red, blue, green and yellow, which are inscribed with numerical characters 21. A plurality of square members 22 are freely received in recessed openings 23, through board wall 14, and a plurality of spaced-apart openings 24, through square members 22, provide a means of receiving a peg 25, which is removably received in a bottom opening 26 of a plurality of simulated building structures 27.

Each square member 22 includes a mechanism 28, for causing them to tilt in a vibrating manner, and a bracket 29 supports each mechanism 28, and is secured to the bottom side of top wall 14, by means of suitable fasteners 30. An electric motor 31 is suitably secured to bracket 29, in a manner (not shown), and shaft 32, of motor 31, is fixedly secured in the central opening 33 of metal disc 34. A space 35, between disc 34 and motor 31, enables disc 34 to rotate freely, and a rod 36 is fixedly secured to the end of motor shaft 32, at one end, and is rotatably secured to roller 37, which rides on the top of a plastic disc 38. A plurality of equally spaced-apart posts **38*a* are fixedly secured, at one end, to the bottom of disc 38, and are fixedly secured, at their opposite ends, to bracket 29, so as to provide support means for disc 38. The top surface of disc 38 includes alternately spaced-apart grooves 39 and cam portions 40, so as to tilt square member 22. A wire 41 is electrically secured to disc 34, at one end, and is secured, at its opposite end, to one side of batteries 42. The opposite side of batteries 42 are connected, by wire 43, to one side of motor 31, and the opposite side of motor 31 is secured to a brush 44, which is engageable with disc 34, by means of lever arm 45, when its end button 46 is urged downward by a player, the lever being pivotally secured to a side wall 12**, in a manner (not shown).

In use, game 10 is started by the players rolling a pair of dice 47, and then moving around the segments 15, each of which represents a monetary loss, gain or bonus segment 15; however, at certain intervals there are the segments labeled "earthquake." When the players land on the above mentioned segment 15, they must spin the spinner 19, and whatever color the needle 48 stops on, that is the particular color of one of the square members 22, where the simulated earthquake is to occur, as the members 22, starting from the top of the board 11, are red, blue, green and yellow, which are the same on the spinner 19 face. The colors of the buttons 46 also correspond to their respective square member 22, that are designated as cities, and each button 46 is an activator, individually, for its respective square member 22.

The primary rule of game 10 is, that if a player is to win, he must build his city, by buying and putting up building structures 27, while trying to best the earthquakes, and it is to be noted, that the structures 27 are twenty-one in all. The players must buy a peg 25, during certain parts of game 10, which are called earthquake sensors, and they are placed in the openings 26 of the structures 27, and in the openings 24 of the members 22.

The above mentioned arrangement causes the structures 27 to be earthquake proof, and when all of the structures 27 are brought, and made earthquake proof, then that player is declared the winner.

When a button 46 is pressed by a player, the attached lever arm 45 lifts brush 47 onto metal disc 34, and closes the circuit between motor 31 and the batteries 42, causing motor 31 to rotate shaft 36, at slow speed. The freely rotating roller 37 alternately rides in grooves 39, and upon the cam surfaces 40, and, while doing so, lifts member 22 to simulate an earthquake. The above mentioned is a one revolution cycle, and a small indentation 47 serves as a means for breaking the circuit, after one revolution of motor 31.

Figure 10:
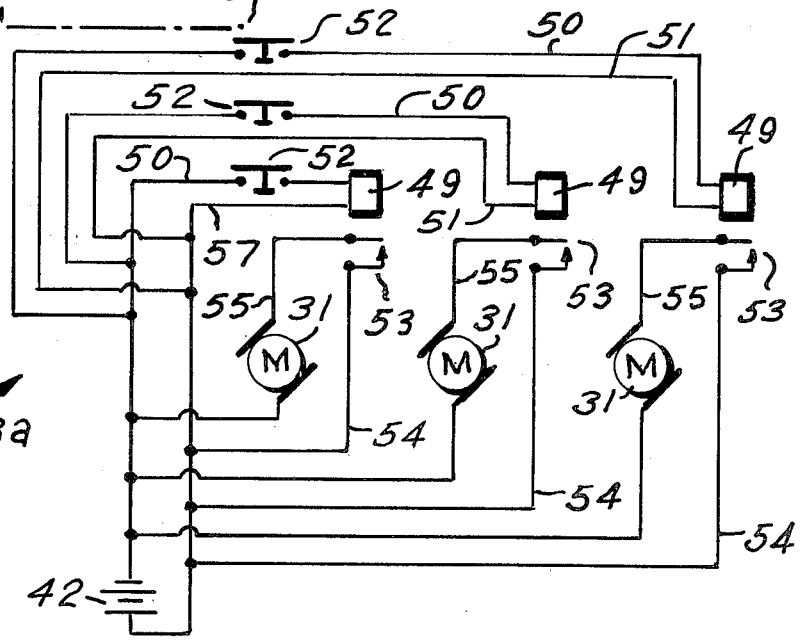
FIG. 10 is a schematic wiring diagram of a modified form of motor drive for the invention.

Referring now to FIG. 10 of the drawings, a modified circuit **48*a*, for driving motors 31, includes three time-delay relays 49, which are connected by wires 50 and 51, across batteries 42, and each relay 49 includes a switch 52 in series with its respective wire 50, for activation thereof. Contacts 53, of relays 49, are also secured, by wires 54 and 55, to batteries 42, so as to close the circuits of motors 31**.

In use, when a switch 52 is closed by a player, its respective time-delay relay 49 will close its contacts 53, which will supply power to the respective motor 31, for a full revolution of motor 31, thus providing the same effect of the heretofore described mechanism 28, without the lever arm 45, brush 44 and disc 34 components.

While various changes may be made in the detail construction, it is understood that such changes will be within the spirit and scope of the present invention, as is defined by the appended claims.

What I now claim is:

1. An earthquake game, comprising, in combination, a board, with a pair of side walls, and a pair of end walls fixedly secured to it in a suitable manner, a border of adjacent segments imprinted on said board, for use with a plurality of playing cards, a plurality of square members freely received in openings through said board, for simulating cities, a plurality of mechanisms with circuit means, secured to said board, for vibrating each of said square members, a plurality of building structures removably received on said square members, a spinner device inscribed on said board, for selecting which square member is to be vibrated by the players, and a pair of dice for the use of each player, to determine which player will start said game off.

2. The combination according to claim 1, wherein said spinner device is divided into segments, each of a different color, each of said square members color coded to correspond with said segments of the same color coding, and buttons extending from one of said side walls are each colored the same as each square member that is to be activated, said buttons, being secured to an individual lever arm, for activating its respective said mechanism.

3. The combination according to claim 2, wherein each of said square members are spaced apart, and include mosaic grid lines, some of the crossing points of said grid lines having an opening for removably receiving a peg, and said peg is removably received in the bottom surface of one of said building structures, which enables said building structure to remain standing on the top surface of its said square member, when it is vibrated by its respective mechanism.

4. The combination according to claim 3, wherein a plurality of brackets are secured, at their flanged sides, to the bottom of said board, by suitable fasteners, and an electric motor is secured within, and to, each of said brackets in a suitable manner, and a metal disc is fixedly secured, in a suitable manner, to the shaft of said motor, and said metal disc contacts with one end of a wire that is secured to one side of batteries received on the underside of said board, and the opposite side of said batteries are secured to a terminal on said motor, the opposite terminal of said motor being secured to a brush, which is raised to the surface of said metal disc by said lever arm secured to its said bottom by pivotal means, and when said brush is in contact with said metal disc, the circuit of said mechanism is completed, and said shaft of said motor includes a rod fixedly secured to said shaft of said motor at one end, and a freely rotatable roller is secured to its opposite end, so as to be in rolling engagement with a plastic disc, fixedly secured to one end of a pair of posts, and the opposite ends of said pair of posts are fixedly secured to said bracket.

5. The combination according to claim 4, wherein said roller, when said motor is rotating, rides alternately in radially spaced-apart grooves on top of said plastic disc, and alternately on alternately and radially spaced-apart cam surfaces, on top of said plastic disc, when said rod is being rotated by said motor.

6. The combination according to claim 5, wherein said roller, when on top of said cam surfaces, is in rolling engagement with the underside surface of said square member, and lifts said square member on its sides, so as to topple said building structures.

7. The combination according to claim 6, wherein the opening receiving said square member includes a shoulder on each side edge, for supporting said square member, which is freely received in said opening.

* * * * *